US008438885B2

(12) United States Patent
Calder

(10) Patent No.: US 8,438,885 B2
(45) Date of Patent: May 14, 2013

(54) SECURITY APPARATUS

(75) Inventor: Paul Robert Calder, Midlothian (GB)

(73) Assignee: Scotia Safes Limited (GB)

( * ) Notice: Subject to any disclaimer, the term of this patent is extended or adjusted under 35 U.S.C. 154(b) by 91 days.

(21) Appl. No.: 12/864,536

(22) PCT Filed: Feb. 2, 2009

(86) PCT No.: PCT/GB2009/000275

§ 371 (c)(1),
(2), (4) Date: Aug. 10, 2010

(87) PCT Pub. No.: WO2009/095692

PCT Pub. Date: Aug. 6, 2009

(65) Prior Publication Data

US 2010/0307205 A1 Dec. 9, 2010

(30) Foreign Application Priority Data

Feb. 1, 2008 (GB) ..... 0801848.3

(51) Int. Cl.
*E05B 65/44* (2006.01)
*E05G 1/00* (2006.01)

(52) U.S. Cl.
USPC ..... 70/78; 70/85; 70/DIG. 64; 70/DIG. 65; 70/DIG. 66; 109/47; 109/53; 109/57; 312/215; 902/13

(58) Field of Classification Search ..... 70/DIG. 64, 70/DIG. 65, DIG. 66, 77–86; 109/45, 47, 109/56, 57, 49, 53; 312/215, 216; 292/DIG. 18, 292/DIG. 21; 902/9, 13, 30, 31
See application file for complete search history.

(56) References Cited

U.S. PATENT DOCUMENTS 838,437 A * 12/1906 McDaniel ..... 312/351
1,695,896 A * 12/1928 Holden ..... 312/216

(Continued)

FOREIGN PATENT DOCUMENTS

| | | |
|---|---|---|
| DE | 9100386 | 4/1991 |
| EP | 0265393 | 4/1988 |
| GB | 2363425 | 12/2001 |

OTHER PUBLICATIONS

PCT/GB2009/000275 International Search Report.

(Continued)

*Primary Examiner* — Lloyd Gall
(74) *Attorney, Agent, or Firm* — Snell & Wilmer L.L.P.

(57) ABSTRACT

The present invention, relates to an apparatus for securing cassettes housed within an automatic teller machine (ATM). The apparatus comprises at least one barrier and a supporting structure for supporting at least one barrier. Each barrier is formed and arranged to be associated with a pair of adjacent cassettes and to be movable between a first position in which the barrier prevents removal of a pair of adjacent cassettes in use of the apparatus along their respective removal paths. The barrier is moveable to a second position in which the barrier prevents removal of one cassette of the pair of adjacent cassettes along its removal path and to a third position in which the barrier prevents removal of the other cassette of the pair of adjacent cassettes along its removal path. In use, only one cassette of a pair of adjacent cassettes is removable along its removal path when the barrier is in the second or third position. The apparatus is further formed and arranged so that the barrier (or barriers) can be moved to a 'service' position so that both cassettes can be accessed and removed along their removal paths and for servicing of the ATM.

10 Claims, 7 Drawing Sheets

U.S. PATENT DOCUMENTS

| | | | | |
|---|---|---|---|---|
| 1,898,543 | A * | 2/1933 | Johnson | 292/241 |
| 2,126,333 | A * | 8/1938 | Kirk | 70/265 |
| 2,486,460 | A | 11/1949 | Bonenberger | |
| 3,913,997 | A * | 10/1975 | Pull et al. | 312/324 |
| 4,078,836 | A * | 3/1978 | Wilson | 292/259 R |
| 4,688,492 | A * | 8/1987 | Peghetti | 109/56 |
| 4,829,887 | A * | 5/1989 | Holschbach | 454/56 |
| 5,103,659 | A * | 4/1992 | Benefield, Sr. | 70/94 |
| 5,108,162 | A | 4/1992 | Lund | |
| 5,267,688 | A * | 12/1993 | Benefield | 232/17 |
| 5,915,802 | A * | 6/1999 | Siler | 312/216 |
| 6,428,125 | B1 * | 8/2002 | Nakazawa et al. | 312/216 |
| 6,641,236 | B2 * | 11/2003 | Grudzien | 312/216 |
| 6,921,990 | B1 * | 7/2005 | Higgins | 307/328 |
| 7,040,125 | B2 * | 5/2006 | Ciezki et al. | 70/208 |
| 7,156,475 | B2 * | 1/2007 | Gloger, Jr. | 312/216 |
| 7,201,027 | B2 * | 4/2007 | Gogel | 70/56 |
| 7,278,284 | B1 * | 10/2007 | James | 70/56 |
| 2002/0007771 | A1 * | 1/2002 | Braddock | 109/47 |
| 2010/0301716 | A1 * | 12/2010 | Ranitlla | 312/215 |

OTHER PUBLICATIONS

Written Opinion dated Aug. 6, 2009 in Application No. PCT/GB2009/000275.

International Preliminary Report on Patentability dated Aug. 3, 2010 in Application No. PCT/GB2009/000275.

* cited by examiner

First position

Second position

Third position

First position

Second position

Third position

SECURITY APPARATUS

CROSS-REFERENCE TO RELATED APPLICATIONS

This application is a U.S. national phase filing under 35 U.S.C. §371 of PCT/GB2009/000275 filed Feb. 2, 2009, both of which claim priority from United Kingdom Application No. GB 0801848.3 which was filed on Feb. 1, 2008, both of which are incorporated herein by reference.

FIELD OF THE INVENTION

The present invention relates to a security system and apparatus for use with an automatic teller machine (ATM).

BACKGROUND OF THE INVENTION

ATMs are well known devices that allow a user to withdraw cash from a bank account without the need for a teller. ATMs are designed to be highly secure as large amounts of cash are stored therein. A standard ATM includes currency cassettes, in which banknotes are loaded. These currency cassettes are slotted into a housing to form a stack, and each currency cassette can only be removed from the housing by sliding it out in a removal path in a similar fashion to sliding open a drawer. This stack is housed inside a secure body and access can only be gained to the currency cassettes by opening a secure housing door of the secure body.

One major security weak point still exists in many ATMs. That is, all of the cash stored within the cassettes is at high risk from theft when the housing door of an ATM is opened to replenish the cash or to allow servicing or maintenance to be performed. To address this security weak point, a number of ATM security apparatus have been proposed.

U.S. Pat. No. 5,915,802 discloses a locking device comprising a locking bar which is mounted across the front of a stack of cassettes running from top to bottom of the stack, to simultaneously block the removal path of each cassette thereby preventing the cassettes from being slid out from their respective housings. Using this apparatus, the interior of an ATM can be divided into two distinct security zones: (i) a low security zone in which a person such as a repair man can service the ATM without compromising the security of the cash contained therein and (ii) a high security zone in which a person of high security clearance can gain access to the cash. However, when the locking bar is removed to allow access to one of the cassettes for refilling or replacing, all of the cassettes and the cash they contain become accessible and vulnerable to theft.

UK Patent 2,363,426/US 2002/0007771 A1 discloses an apparatus for preventing the removal of cassettes from an ATM, the apparatus including mounting means, and a plurality of locking bars that can be secured in locked positions on the mounting means. In this apparatus each locking bar corresponds to a single cassette and when in the locked position, a locking bar blocks the removal path of only its corresponding cassette, thereby preventing the cassette from being slid out of the housing. Each locking bar corresponds to a single cassette, and consequently when a single cassette is unlocked for refilling or replacement, none of the other cassettes need to be unlocked. However, this arrangement has drawbacks in that, by having an individual locking bar for each cassette, manufacture, installation and operation of the security bars and associated locking mechanisms is complex and costly. In particular, for smaller stand-alone ATMs of the type that can be found in bars and convenience stores, or ATMs with increased security levels and therefore thicker bodies, installation complexity is increased as the amount of space available in the interior of these machines is extremely limited. GB 2449748 also describes a security assembly which has a plurality of doors with each door securing a respective cash containing cassette. This arrangement has similar drawbacks to those mentioned above.

It is the objective of the present invention to avoid or minimize one or more of the above disadvantages.

SUMMARY OF THE INVENTION

According to a first aspect of the present invention, there is provided an apparatus for securing cassettes housed within an automatic teller machine (ATM), the apparatus comprising at least one barrier and a supporting structure for supporting said at least one barrier; a said at least one barrier being formed and arranged to be associated with a pair of adjacent cassettes and to be movable between a first position in which the barrier prevents removal of a said pair of adjacent cassettes in use of the apparatus along their respective removal paths; a second position in which the barrier prevents removal of one cassette of a said pair of adjacent cassettes along its removal path; and a third position in which the barrier prevents removal of the other cassette of the said pair of adjacent cassettes along its removal path, whereby, in use, only one cassette of a said pair of cassettes is removable along its removal path when the barrier is in said second or third position.

Each barrier may extend at least partially across the width of its associated cassettes. Preferably, said barrier extends across the full width of its associated cassettes. Each barrier may be a solid plate or series of plates of differing materials and may incorporate materials that are resistant to cutting or thermal attack. Alternatively each barrier may be a plate having a removed central portion or more than one removed portion, or may be formed of a plurality of spaced apart bars. Alternatively, each barrier may comprise a C-shaped or E-shaped bar or L-shaped bar or variations thereon.

Additionally, the shape and dimensions of the barriers must be sufficient such that each barrier can: simultaneously block both cassettes of a corresponding pair when in the first position; and move a sufficient vertical distance to allow removal of the upper and lower cassettes of its corresponding pair while not interfering/colliding with any other barriers that may be included in the apparatus. The size of currency cassette employed varies between ATM manufacturers, and thus the dimensions of the barrier may vary. As a non-limiting example, one current ATM manufacturer utilises cassettes with rectangular shaped ends of 350 mm Wide×130 mm High. Thus the height of each barrier would preferably be in the range of 100 mm to 130 mm to facilitate operation, provide adequate security protection and allow standardisation of components for a wide range of ATM models and manufacturer.

Preferably, the supporting structure comprises a main support beam extending in the stacking direction of cassettes, the main support beam supporting one end of each barrier. In addition the supporting structure may further comprise a base plate from which the main support beam extends, the base plate being installed on the lower surface of an ATM interior. Additionally, the supporting structure may further comprise a secondary support beam arranged in parallel with and spaced apart from the main support beam and positioned to support the end of each barrier which is not supported by the main support beam. Preferably the secondary support is a keeper plate. The secondary support/keeper plate can either mount to the base plate to which the main support column is mounted or on to a separate base plate or more preferably is mounted to the side of the ATM dispenser mechanism using spare fixings points provided at the time of ATM manufacture.

The supporting structure may further comprise additional bracing parts to further increase the strength of the supporting structure and to facilitate it being fixed inside an ATM. The additional bracing parts also provide extra resistance to attacks such as attacks using sledgehammers or prising devices. In addition, by utilising existing threaded holes, brackets, structures and apertures in an ATM safe body which are formed at the time of ATM manufacture, the apparatus for securing cassettes housed within an automatic teller machine offers the competitive advantage of quick and efficient installation with a minimum of ATM 'downtime' and without detrimental affect to the security rating of the ATM safe body.

The apparatus may comprise means for allowing each barrier to move between the first through third positions. Preferably, each barrier may have a vertically arranged aperture formed in an end thereof to be fed into a guide post or posts that is/are installed in the main support beam allowing each barrier to vertically move along the guide post(s). In addition, constant force springs may be installed for each barrier, giving an appropriate weighting to each bar to assist a user in moving the barriers. Alternatively, a worm drive may be installed in the main support beam to allow vertical barrier movement. Advantageously, said worm drive may be driven by a motor. Alternatively, each barrier may slide vertically along rails installed on the main and/or secondary support beam. Alternatively, the apparatus may comprise at least one barrier installed on the main support beam via a pivot point which rotates around an axis substantially parallel to the direction of the removal path. Preferably, the barrier is fan shaped and tapers towards the main support beam. Each said at least one barrier can be rotated around said pivot point such that the top and bottom edges of the barrier can be moved between the first position, the second position and the third position. Alternatively, the apparatus may comprise two main support beams formed on either side of the cassette housing and at least one barrier extending between the two main support beams. A said at least one barrier having retractable bolts installed at each corner thereof wherein each bolt can extend into corresponding receiving portions in the two main support beams. The said at least one barrier is in the first position when all bolts thereof are engaged. When top ones of the bolts are released and bottom ones of the bolts are maintained engaged, the said at least one barrier can be swung outwardly and down to be moved to the second position. When the bottom bolts are released and the top bolts are maintained engaged, the said at least one barrier can be swung outwardly and up to be moved to the third position. Each barrier may be provided with a drive means which may be hydraulic, electrical, pneumatic or may be manually operated. Furthermore, as the barriers of the present invention are not required to be removed from the supporting structure in order to allow access to a particular cassette, the likelihood of damage to the parts of the barriers can be reduced, and greater protection from the ingress of dirt or foreign materials can be provided.

Each barrier may be lockable in the above-mentioned first position by means of a locking device. If desired, each barrier may be lockable in each one of the first through third positions by means of a plurality of locking devices. In addition, two or more locking devices may be employed for each of the first through third positions, wherein the locking devices may be operated by keys held by the same or different individuals. The locking devices may be mechanical or electromechanical locking devices. Examples of these are, motorised bolts, solenoid locks, and key locks. In addition, the locking devices may be either locally or remotely operable to permit a wide range of opening permutations of including set sequences, part access, time locking and time delay. If desired there can be provided time delays between moving the barrier between the first through third positions and if desired the locking devices may be set to open only once per day or in a set sequence for example.

In addition, the apparatus may further comprise a control unit which permits different access levels to different users via at least one security key switch or key code. The control unit may be mounted in an appropriate location such as the door of an ATM in which the apparatus is to be installed and may be used to control the locking and unlocking of the locking devices. The control unit may incorporate a touch screen display which may provide the user with operating instructions and reduce the need for training. The apparatus can further comprise separate mechanical override switches which allow opening of the barriers in the event of system failure.

Preferably, the main support beam has a channel or channels in which said locking means are installed, whereby said locking means are concealed in the channel(s) during operation thus improving protection of the locking means from attack. If employed, the secondary support beam or keeper may also comprise a channel(s) in which said locking means are installed. In addition, the above mentioned components for allowing each barrier to move may also be installed within the channels to further protect each barrier from being derailed or removed from the support structure, thus further enhancing the security of the apparatus.

The apparatus can be placed in a service mode to allow, for example, the removal of the dispenser mechanism from an ATM in which the apparatus is installed in order for servicing to be carried out on said ATM. To enter this service mode the barrier(s) is (are) moved into a service position. In this service position the end(s) of the barrier(s) supported by the secondary support beam/keeper is (are) exposed by the service channel portions and can pass therethrough when the barrier(s) is (are) swung open around a hinge mechanism in the main support beam. The location of the service position is not restricted and may be near the centre or near opposite ends of the main support beam. It should be noted that the service position may vary to correspond to a specific ATM model or manufacturer. Alternatively, a service position locking device is further included to correspond to the service mode to ensure that the barrier(s) can only be swung open when the service locking device is released. When servicing is complete, the barrier(s) may be swung back and secured as required.

Depending on the ATM manufacturer or model of ATM, the main supporting beam, may be located to the left or right hand side of the dispenser mechanism. The secondary support column or keeper therefore may be located on either side of the dispenser. With a design symmetrical about the midpoint of the vertical stack of cassettes the same apparatus can be rotated 180 degrees and mounted on either side of the dispenser mechanism and therefore used on any variant of ATM with only minor changes to the support bracketry required, allowing further savings in the cost of production and installation.

DESCRIPTION OF THE DRAWINGS

Further preferred features and advantages of the present invention will now be described with reference to the embodiments shown in the accompanying drawings in which:—

DETAILED DESCRIPTION OF EXAMPLE EMBODIMENTS

Figure 1A:
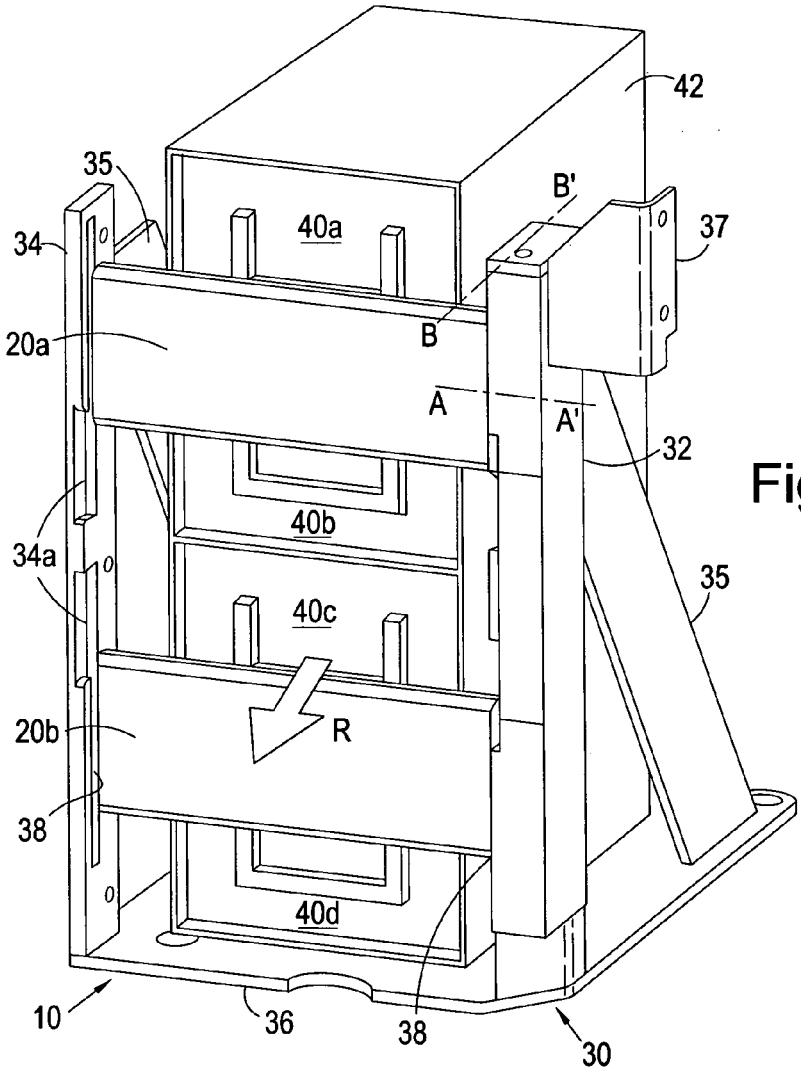
FIG. 1*a* is a perspective view of an apparatus for securing cassettes housed within an automatic teller machine (ATM) in accordance with a first embodiment of the present invention.

Referring to FIG. 1*a*, an apparatus 10 for securing cassettes housed within an automatic teller machine (ATM) is shown. In more detail, the apparatus 10 includes: two barriers 20, an upper barrier 20*a* and a lower barrier 20*b*; and a supporting structure 30 for supporting the barriers 20. The apparatus 10 is installed inside the ATM. Each barrier 20 of the apparatus 10 is arranged to extend across the front of a pair of adjacent cassettes 40 stacked within the ATM. The cassettes 40 (*a, b, c* and *d*) are slotted into a cassette housing 42, the cassette housing 42 being installed inside the ATM.

In order for a cassette 40 to be removed, it must be pulled out along a removal path in a direction indicated by arrow R.

The supporting structure 30 comprises a vertical beam 32 spaced apart from a keeper plate 34, both mounted on a base mounting plate 36. The vertical beam 32 has two channels 38 formed vertically along inner sides thereof and the keeper plate 34 has two channels 38 formed to correspond to those of the vertical beam 32. The keeper plate 34 further includes cut-out portions 34*a* for facilitating a service mode that will be described further below.

The supporting structure 30 further comprises additional bracing parts to increase the strength thereof. Two diagonal bracing bars 35 extend from the vertical beam 32 and the keeper plate 34 to the base mounting plate 36. The bracing bars 35 increase strength of the supporting structure 30, and facilitate the apparatus 10 to be bolt fixed to existing ATM plinth fixing holes making installation convenient. A corner bracket 37 is attached to the upper lateral side of the vertical beam 32 and is fixed to two tapped holes which are included in existing ATM bodies to improve operational stability and to eliminate the need to drill and tap holes in the ATM body.

On the majority of ATM's the supporting structure will attach to a jacking mechanism (not shown) which will create a force between the floor and ceiling of the ATM to retain the structure in place, without the need to create any additional fixing points within the ATM. Furthermore, the additional bracing parts provide extra resistance to attacks such as attacks using sledgehammers or prising devices.

Figure 1B:
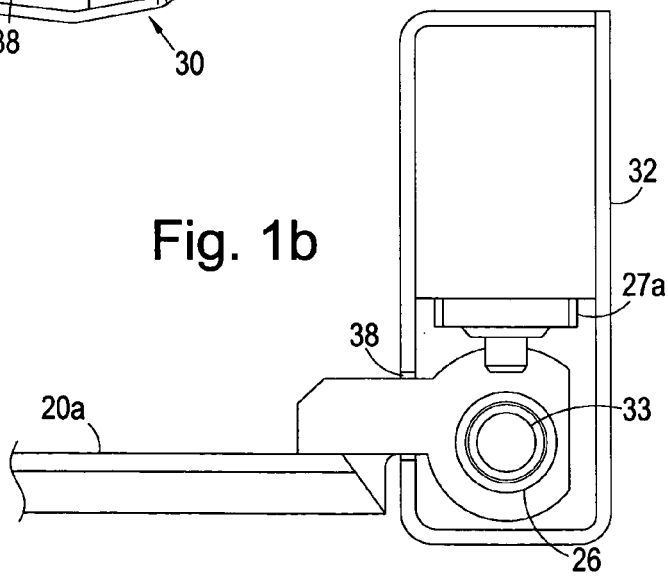
FIG. 1*b* is a top cross sectional view of a portion of the apparatus of FIG. 1 taken along line A-A'.

The barriers 20 *a, b* are inserted into the opposite pairs of channels 38 formed in the vertical beam 32 and the keeper plate 34, such that each barrier 20 faces a pair of adjacent cassettes. The upper barrier 20*a* faces a first pair of adjacent cassettes 40*a,b* and the lower barrier 20*b* faces a second pair of adjacent cassettes 40*c,d*. A 12 mm diameter guide post 33 is installed in installation portions (not shown) of the vertical beam 32 and extend in a vertical direction thereof. Each barrier 20 has a vertically arranged aperture 26 formed in an end thereof into which the guide post 33 that is installed in the vertical beam 32 is fed. The guide post/aperture arrangement can be more easily seen by referring to FIG. 1*b*. In this arrangement, the barriers 20 can be moved vertically along the guide post 33 to various positions that will be described further below.

Figure 1C:
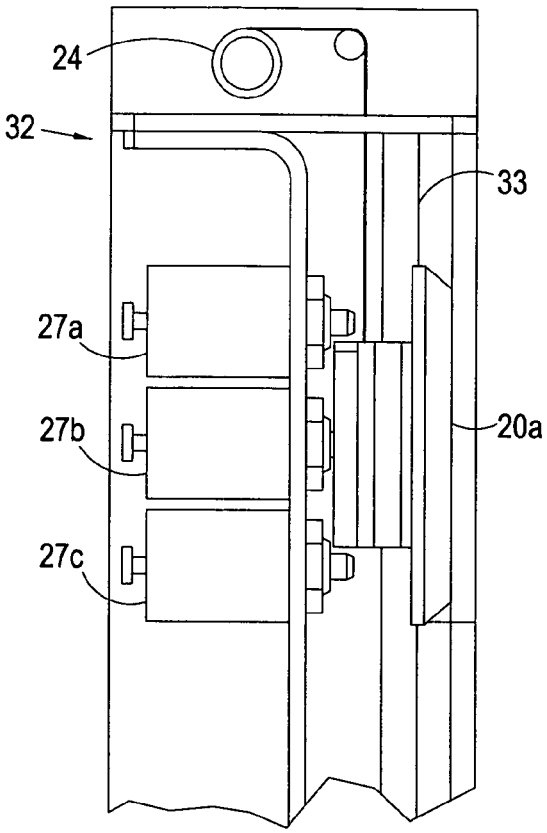
FIG. 1*c* is a cross sectional view of a portion of the apparatus of FIG. 1 taken along line B-B'.

Referring to FIG. 1*c*, constant force springs 24 are installed to give an appropriate weighting to each barrier 20 to assist a user in moving the barriers 20. The selected strength of each constant force spring 24 will ensure smooth, low effort movement of the barrier 20 along the guide post 33. Different barrier 20 designs, and hence weight or weight distribution and resultant resisting force, will determine the size and strength of the constant force spring employed.

Three locking devices 27 are provided per barrier, an upper locking device 27*a*, a middle locking device 27*b* and a lower locking device 27*c*, are installed in the vertical beam 32. In this arrangement solenoid locks are employed as the locking devices 27, however, it should be noted that other kinds of locking devices, e.g. motorised bolts, may also be employed as the locking devices 27. Each locking device 27 can be extended to block a top or bottom edge of a corresponding barrier 20 or can be retracted to allow a top or bottom edge of a corresponding barrier 20 to pass thereby. Additionally each locking device 27 can lock into the barrier 20, rather than merely block its path. Therefore, each barrier 20 can be locked in any one of three positions which will be described below in order to allow access to the cassettes 40 one at a time.

Figure 1D:
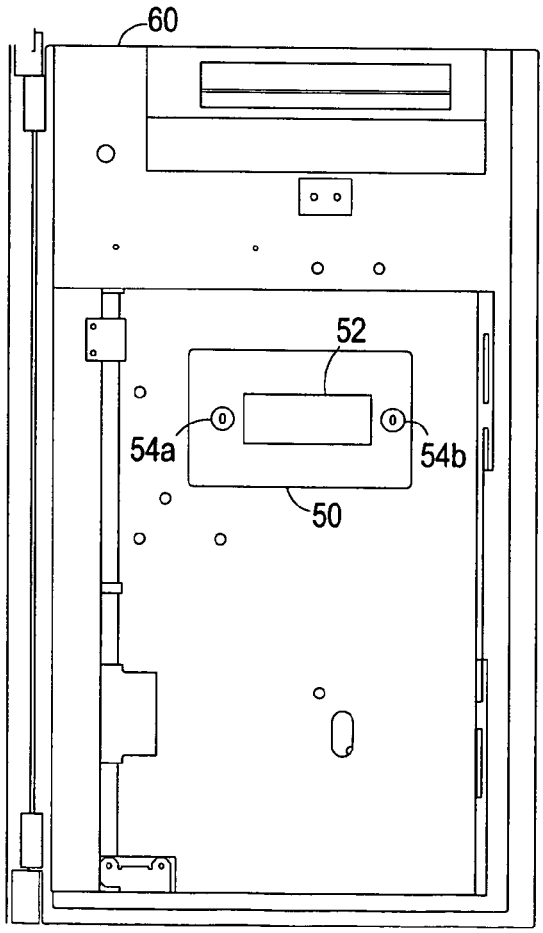
FIG. 1*d* is a view of a control unit for use with the ATM in FIG. 1.

Referring to FIG. 1*d*, the locking devices 27 are controlled electromechanically by a control unit 50 mounted in the door 60 of the ATM in which the apparatus 10 is installed. Sensors such as microswitches or reed sensors (not shown) monitor the position of each barrier 20 and provide information to the control unit 50 for it to control operation of the locking devices 27. The control unit 50 further comprises a visual monitor 52 which displays information such as locking information to a user. The control unit 50 permits different access levels to different users via two high security key switches 54*a* and 54*b*. A touchscreen (not shown) of the controller negates the need for keys and may be utilised in conjunction with variable length key codes. Locking functions, such as, add time lock, time delay and remote operation facilities can be selected as required by the user via the control unit 50.

The apparatus 10 further comprises separate mechanical override switches (not shown) which allow opening of the barriers 20 in the event of system (or power) failure.

Figure 2A:
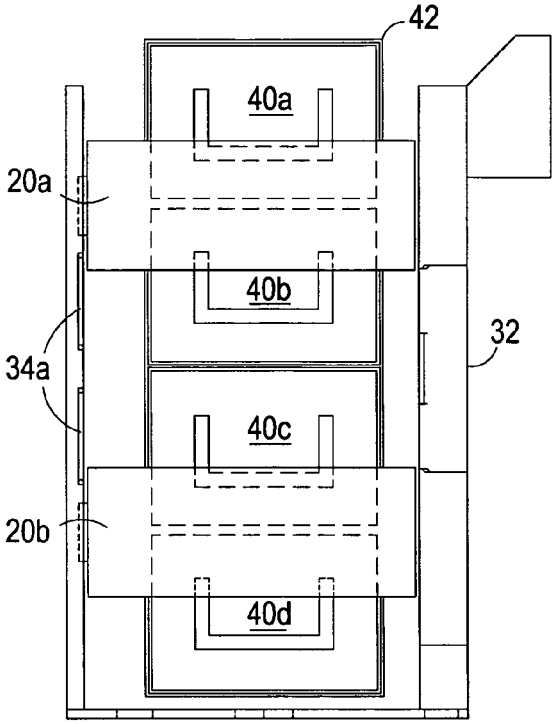
FIG. 2*a* through 2*e* are front views of the apparatus of FIG. 1 showing accessing of the cassettes.
Figure 2B:
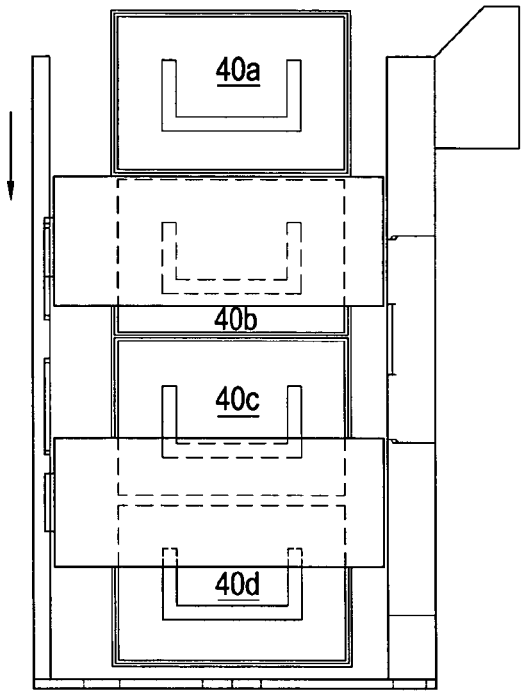

The mode of operation of the apparatus 10 for securing cassettes housed within an ATM shall now be described with reference to FIGS. 2 and 3. In FIGS. 2 and 3 the dashed lines indicate edges of the cassettes 40 which are hidden from view by the barriers 20. With reference to only the upper barrier 20*a* and the first pair of adjacent cassettes 40*a,b*, when in a first position shown in FIGS. 2*a* and 3*a*, the upper barrier 20*a* blocks the removal paths of both adjacent cassettes 40*a,b* and thus prevents removal both cassettes (hereinafter referred to as the "first both blocked position"). The upper barrier 20*a* is maintained in the first both blocked position by the upper and lower locking devices 27*a* and 27*c*. In this position, neither of the first pair of adjacent cassettes 40*a,b* can be removed from their housing and the upper barrier 20*a* is protected, by the upper and lower locking devices 27*a* and 27*c*, from a blow from for example a sledgehammer. When moved to a second position which is shown in FIGS. 2*b* and 3*b*, the upper barrier 20*a* blocks the removal path of the lower cassette 40*b* of the first pair of adjacent cassettes 40*a,b* (hereinafter referred to as "second lower blocked position"). At the same time, the upper barrier 20*a* does not block the removal path of the upper cassette 40*a* and the upper cassette 40*a* can be removed from the housing along its removal path and replenished with cash or replaced with a new cassette. In this position, the upper barrier 20*a* cannot be moved to allow access to the lower cassette 40*b* as the middle 27*b* and upper 27*a* locking devices are engaged.

Figure 2C:
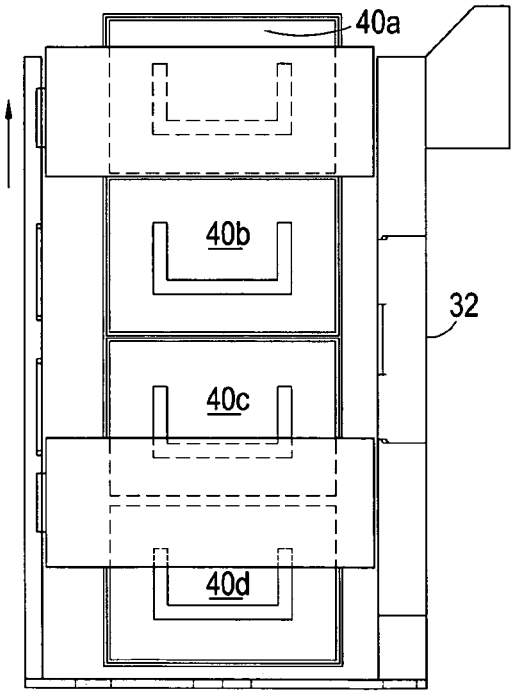
Figure 2D:
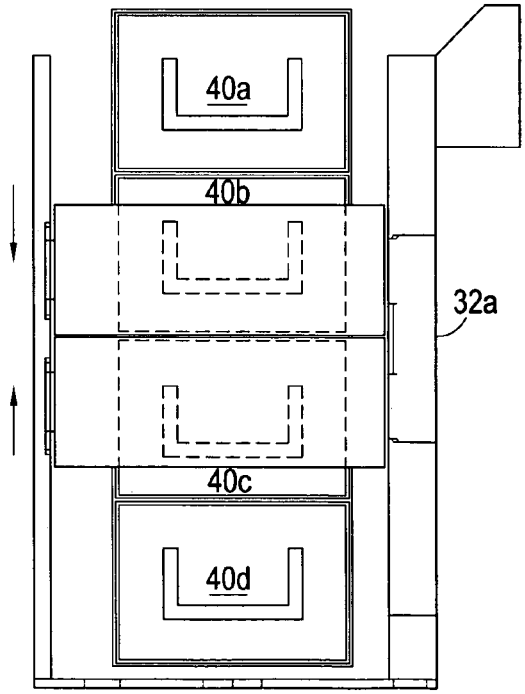
Figure 2E:
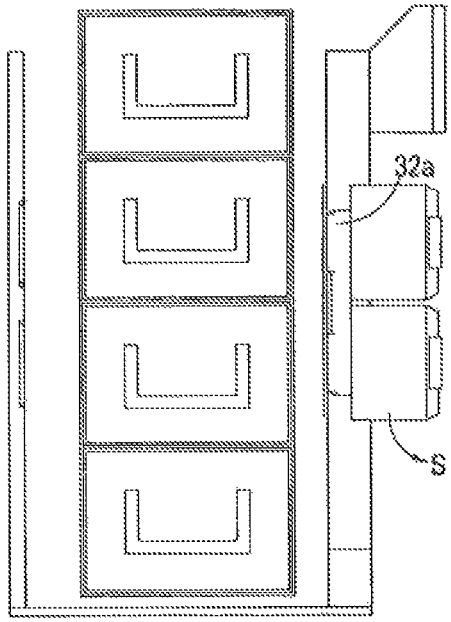
Figure 3A:
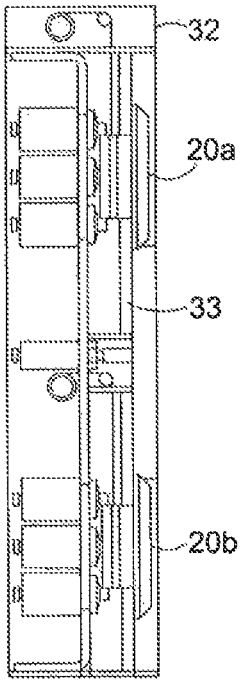
FIGS. 3*a* and 3*e* are cross-sectional views corresponding to FIGS. 2*a* through 2*e;*
Figure 3B:
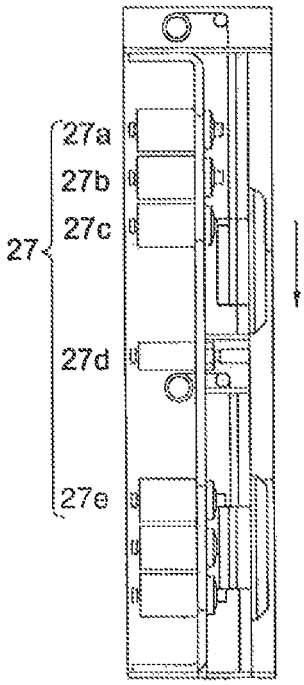
Figure 3C:
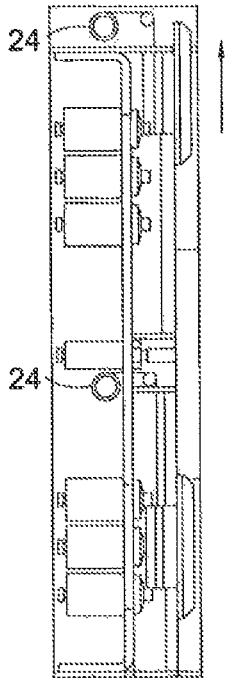
Figure 3D:
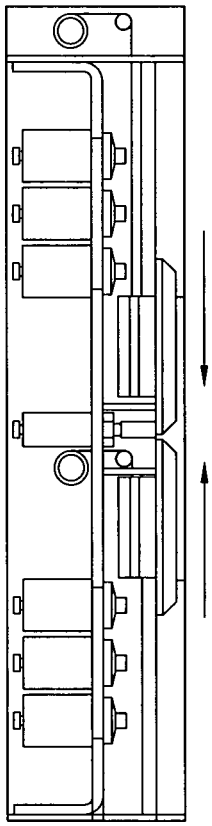
Figure 3E:
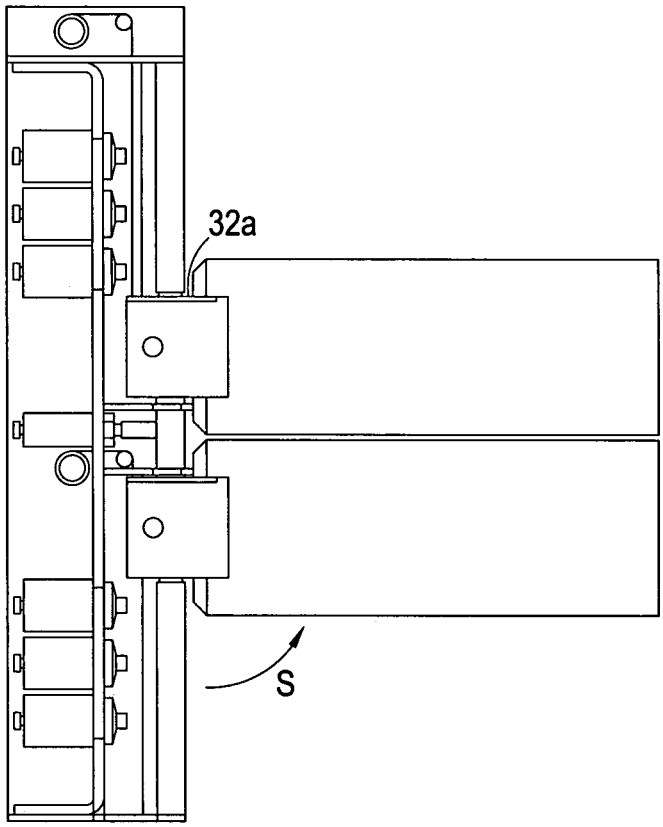

When moved to a third position which is shown in FIGS. 2*c* and 3*c*, the upper barrier 20*a* blocks the removal path of the upper cassette 40*a* of the first pair of adjacent cassettes 40*a,b* and thus prevents removal thereof along its removal path (hereinafter referred to as "third upper blocked position"). At the same time, the upper barrier 20*a* does not block the removal path of the lower cassette 40*b* which can be removed from the housing along its removal path and replenished with cash or replaced with a new cassette. In this position, the upper barrier 20*a* cannot be moved to allow access to the upper cassette 40*a* as the middle 27*b* and lower 27*c* locking devices are engaged.

The shape and dimensions of the upper barrier 20*a* are selected so that it: simultaneously blocks both cassettes of the first pair of adjacent cassettes 40*a,b* when in the first both blocked position; and can be moved a sufficient distance down the guide post 33 to allow removal of the upper cassette 40*a* and can be moved a sufficient distance up the guide post 33 to allow removal of the lower cassette 40*b* while at all times not interfering/colliding with the lower barrier 20*b*. In the present embodiment, the height of each barrier is ~110 mm.

The lower barrier 20*b* can also move in a similar manner (not shown) as the upper barrier 20*a* in order to allow access to the second pair of cassettes 40*c,d* which it secures. The lower barrier 20*b* is maintained in the first both blocked position while the upper barrier 20*a* is in the second or third position (but not the first both blocked position) in order to ensure that access to only one cassette 40 can be gained at any one time.

The apparatus 10 has a service mode to allow servicing of the ATM to be carried out, for example, to allow retraction of the dispenser mechanism. The service mode is described with respect to FIGS. 2*d* and 2*e* and corresponding FIGS. 3*d* and 3*e*. The barriers 20 are moved into a service position shown in FIGS. 2*d* and 3*d* to allow the service mode to be entered. It should be noted that the location of the service position may vary to correspond to a specific ATM model or manufacturer. In this arrangement in which the keeper plate 34 is utilised, in the service position the ends of barriers 20 mounted in are exposed by the cut-out portions 34*a* and can pass therethrough when the barriers are swung outwardly open about a hinge mechanism 32*a* included in the vertical beam 32. The direction of the swing is shown by the arrows 'S' on FIGS. 2*e* and 3*e*. A service mode locking device 27*d* is provided that corresponds to the service position and the barriers 20 can only be swung open when the service mode locking device 27*d* is released. Various locking devices may be employed such as solenoids, motorised bolt or similar electromechanical locking devices override. In this arrangement a solenoid lock is employed as the service mode locking device 27*d*, however, it should be noted that other kinds of locking devices, e.g. motorised bolts, may also be employed as the service mode locking device 27*d*. In an alternative arrangement (not shown) the position of locking devices may be altered to permit locking devices 27*c* and 27*e* to lock into the barriers when in the service position. In this arrangement the barriers can only swing open when locking devices 27*c* and 27*e* are released, eliminating the need for locking device 27*d*. When a service procedure is complete, the barriers are swung back and moved into in the first both blocked position shown in FIGS. 2*a* and 3*a*.

It will be noted that throughout the operation mode and service mode the barriers 20,*a,b* are not required to be removed from the supporting structure 30 in order to allow access the cassettes 40 (*a, b, c* and *d*), and thus the likelihood of damage to the barriers 20, 21, 22 can be reduced, and greater protection from the ingress of dirt or foreign materials can be provided.

Figure 4:
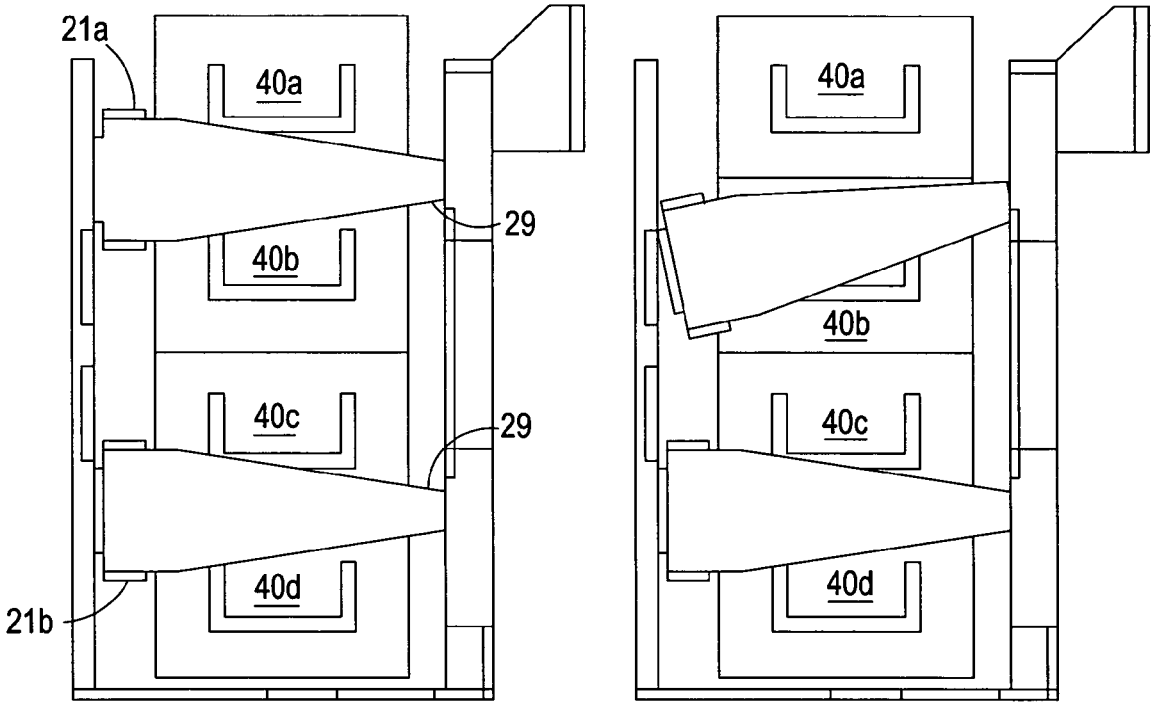
FIG. 4 is a schematic front view of another embodiment of the present invention having a modified barrier arrangement.
Figure 4:
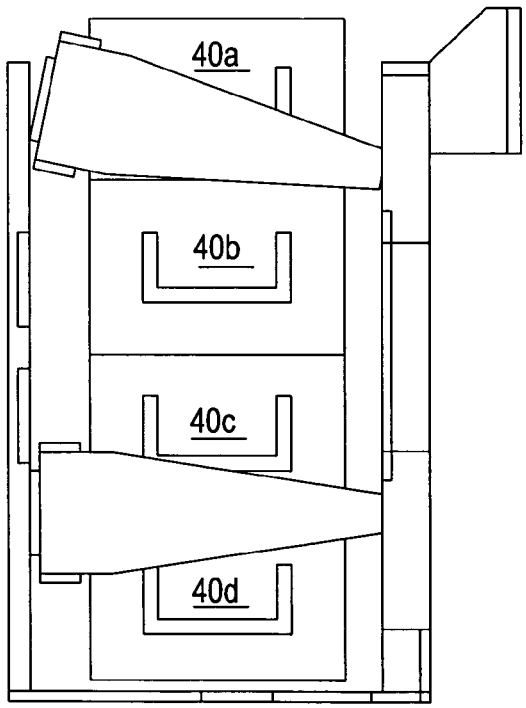

Another embodiment of the present invention is shown in FIG. 4 and comprises rotating plates 29 installed on the vertical beam 32 which rotate around an axis substantially parallel to the direction of the removal path R. Each rotating plate 29 has a fan shaped barrier 21 mounted thereon. As in the previous embodiment, this embodiment comprises two barriers 21; an upper barrier 21*a* and a lower barrier 21*b*. The upper rotating plate 29 can be rotated such that the upper barrier 21*a* is arranged in the first both blocked position in which it extends across a corresponding pair of cassettes 40 *a,b* to prevent them from being removed. The upper rotating plate 29 can be rotated anti-clockwise such that the upper barrier 21*a* moves downwards to the second lower blocked position in which the barrier blocks the lower cassette 40*b* of the pair of cassettes 40*a,b* while not blocking the upper cassette 40*a*. The upper rotating plate 29 can be rotated clockwise such that the upper barrier 21*a* moves upwards to the third upper blocked position in which the barrier blocks the upper cassette 40*a* of the pair of cassettes 40*a,b* while not blocking the lower cassette 40*b*. It will be understood that the lower barrier 21*b* can also move in a similar fashion (not shown) as the upper barrier 21*a*.

Figure 5:
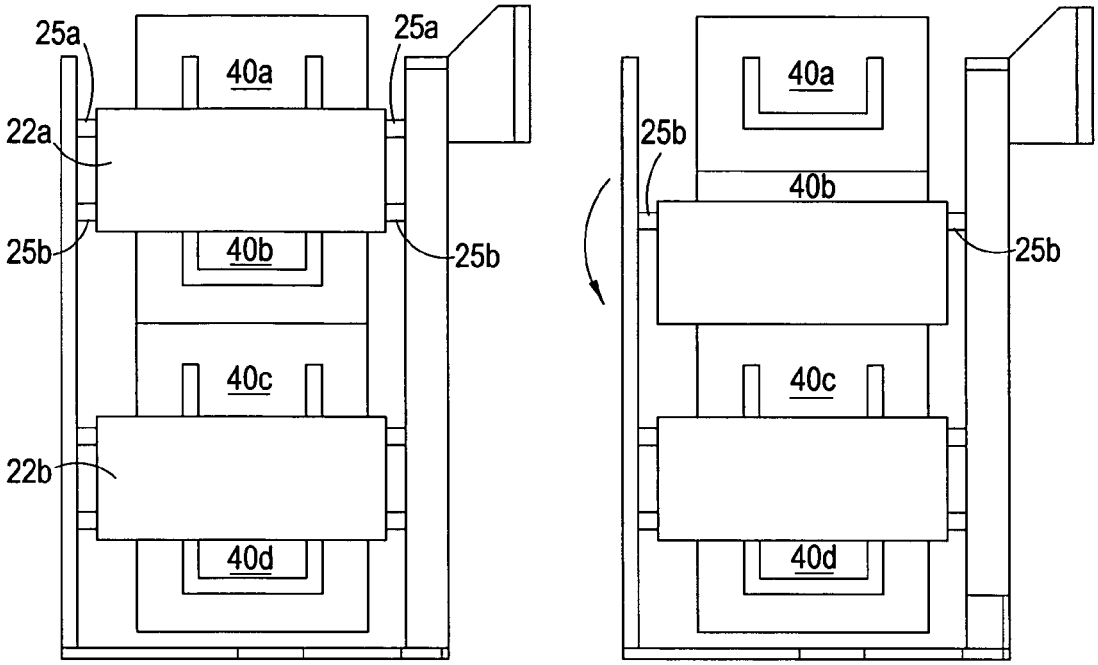
FIG. 5 is a schematic front view of a further embodiment of the present invention having another modified barrier arrangement.
Figure 5:
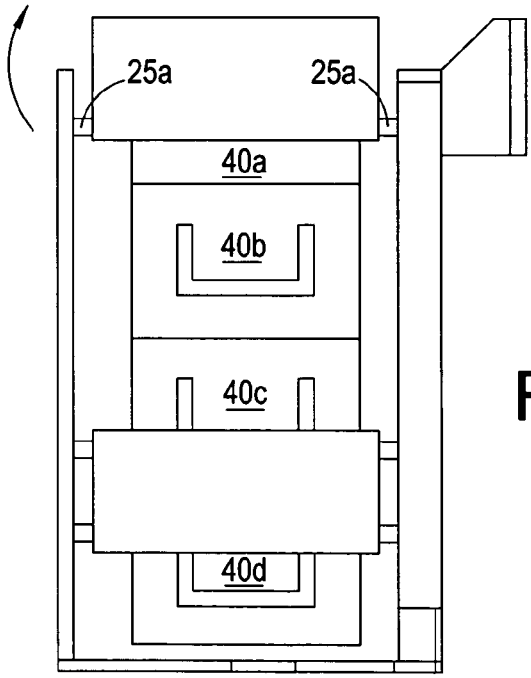

Another embodiment of the present invention is shown in FIG. 5 and comprises right and left vertical beams 32 formed on either side of the stack of cassettes 40 *a,b,c,d* and two rectangular barriers 22 which extend between the right and left vertical beams 32. Retractable bolts 25 are installed at each corner of the barriers 22 and each bolt 25 can extend into corresponding receiving portions (not shown) formed in the channels 38 of the right and left vertical beams 32. An upper barrier 22*a* can be positioned in the first both blocked position when all four bolts 25 are engaged. In this position both cassettes of a corresponding pair of cassettes 40*a,b* cannot be removed due to their removal paths being blocked. When top bolts 25*a* are released (and bottom bolts 25*b* are maintained engaged), the upper barrier 22*a* can be swung outwardly and down to be moved to the second lower blocked position in which the upper cassette 40*a* is exposed and the lower cassette 40*b* is blocked. When the bottom bolts 25*b* are released and the top bolts 25*a* are maintained engaged, the upper barrier 22*a* can be swung outwardly and up to be moved to the third upper blocked position in which the lower cassette 40*b* is exposed and the upper cassette 40*a* is blocked. It will be understood that the lower barrier 22*b* can also move in a similar fashion (not shown) as the upper barrier 22*a*.

The foregoing embodiments are illustrative of how the present invention may be embodied however it is envisaged that other arrangements may be employed which are within the scope of the present invention.

The invention claimed is:

1. An apparatus comprising:

an automatic teller machine (ATM);

a plurality of ATM cassettes configured to be housed within said ATM;

at least one barrier for preventing removal of at least one of a pair of adjacent ATM cassettes from the ATM;

a supporting structure for supporting at least one harrier, wherein said supporting structure comprises a main support beam, a secondary support beam and a base plate from which said main support beam extends;

said main support beam extending in a stacking direction of said ATM cassettes, said main support beam supporting one end of a said at least one barrier;

said base plate configured to be installed on a lower surface of an interior of said ATM;

said secondary support beam arranged in parallel with and spaced apart from said main support beam, said secondary support beam configured to support an end of said at least one barrier which is not supported by said main support beam;

said at least one barrier configured to be movable between (i) a first position in which said at least one barrier prevents removal of said pair of adjacent ATM cassettes in use of said apparatus along their respective removal paths (ii) a second position in which said at least one barrier prevents removal of a first ATM cassette of said pair of adjacent ATM cassettes along its removal path and (iii) a third position in which said at least one barrier prevents removal of a second ATM cassette of said pair of adjacent ATM cassettes along its removal path, whereby, in use, only one ATM cassette of a said pair of ATM cassettes is removable along its removal path when said at least one barrier is in said second position or said third position.

2. The apparatus as claimed in claim 1 where each barrier extends at least partially across the width of its associated pair of ATM cassettes.

3. The apparatus as claimed in claim 1 wherein said at least one barrier extends across the full width of its associated pair of ATM cassettes.

4. The apparatus as claimed in claim 1 which comprises at least one barrier installed on the main support beam via a pivot point which rotates around an axis substantially parallel to the direction of the removal path; each said at least one barrier can be rotated around said pivot point such that top edges and bottom edges of the barrier can be moved between the first position, the second position and the third position.

5. The apparatus as claimed in any one of claims 1, 2, 3 and 4 wherein each barrier is lockable in the first position by means of a locking device.

6. The apparatus as claimed in any one of claims 1, 2, 3 and 4 wherein each barrier is lockable in each one of the first through third positions by means of a plurality of locking devices.

7. The apparatus as claimed in any one of claims 1, 2, 3 and 4 wherein a said barrier is provided with a drive means formed and arranged to move the barrier between said first, second and third positions.

8. The apparatus as claimed in claim 4 wherein the main support beam supporting one end of a said barrier has concealed locking means for locking a said barrier to said main support beam in any one of said first, second or third positions.

9. The apparatus as claimed in any one of claims 1, 2, 3, 4 and 8 wherein said at least one barrier is formed and arranged to be moveable into a service mode position so as to facilitate access to an ATM and its ATM cassettes and their removal along their respective removal paths.

10. The apparatus as claimed in any one of claims 1, 2, 3, 4 and 8 wherein there is provided at least two barriers.

* * * * *